US006632998B1

(12) United States Patent
Gretz

(10) Patent No.: US 6,632,998 B1
(45) Date of Patent: Oct. 14, 2003

(54) PREPACKAGED MOUNTING ASSEMBLY WITH HOLSTERED SCREWS

(75) Inventor: Thomas J. Gretz, Clarks Summit, PA (US)

(73) Assignee: Arlington Industries, Inc., Scranton, PA (US)

( * ) Notice: Subject to any disclaimer, the term of this patent is extended or adjusted under 35 U.S.C. 154(b) by 0 days.

(21) Appl. No.: 10/361,292

(22) Filed: Feb. 10, 2003

Related U.S. Application Data

(63) Continuation-in-part of application No. 10/287,088, filed on Nov. 4, 2002, which is a continuation-in-part of application No. 10/012,584, filed on Nov. 7, 2001, now Pat. No. 6,509,524, and a continuation-in-part of application No. 10/017,571, filed on Oct. 22, 2001, which is a continuation-in-part of application No. 09/784,981, filed on Feb. 16, 2001, now Pat. No. 6,355,883.

(51) Int. Cl.[7] ..... H01H 9/02

(52) U.S. Cl. ..... 174/58; 174/50; 174/53; 220/4.02; 248/906

(58) Field of Search ..... 174/17 R, 50, 174/58, 63, 60, 53; 52/39; 220/4.02, 3.8, 3.6; 439/535; 248/906

(56) References Cited

U.S. PATENT DOCUMENTS 4,309,065 A * 1/1982 Pappas ..... 312/242
5,503,359 A 4/1996 Patterson
5,592,788 A 1/1997 Corridon
5,762,223 A 6/1998 Kerr, Jr.
5,806,269 A 9/1998 Corridon
5,916,094 A 6/1999 Gretz
6,355,883 B1 * 3/2002 Gretz ..... 174/58
6,395,981 B1 * 5/2002 Ford et al. ..... 174/50

* cited by examiner

*Primary Examiner*—Dhiru R Patel

(57) ABSTRACT

A prepackaged mounting assembly for securing an electrical fixture to a sloped ceiling. The prepackaged assembly securely holds all the hardware needed for attaching the mounting block to an overhead beam, including fasteners, without the need for an outer wrap or separate packaging for each separate mounting assembly. The mounting assembly includes two embodiments, one for use with a cathedral ceiling and one for use with a vaulted ceiling. The mounting assembly includes a box having an open top, a closed bottom, a side wall, and an integral electrical wiring enclosure. Integral holsters are provided for temporary storage of threaded fasteners. The wiring enclosure includes a top wall having a seat thereon for flush fitting against an appropriate brace. The box is secured to a brace, the brace secured to an overhead rafter on a sloped ceiling, and an electrical fixture secured to the mounting assembly by removing the threaded fasteners from their respective holsters and securing them through the bracket of the electrical fixture, through receiving apertures in the mounting assembly, and into the brace.

14 Claims, 6 Drawing Sheets

PREPACKAGED MOUNTING ASSEMBLY WITH HOLSTERED SCREWS

This application is a Continuation-In-Part of U.S. patent application Ser. No. 10/287,088 entitled "Prepackaged Mounting Assembly", filed Nov. 4, 2002 still pending which is a Continuation-In-Part of U.S. patent application Ser. No. 10/012,584 entitled "Prepackaged Mounting Assembly, filed Nov. 7, 2001 now U.S. Pat. No. 6,509,524 and a Continuation-In-Part of U.S. patent application Ser. No. 10/017,571 entitled "Electrical Fixture Mounting Box and Mounting Assembly", filed Oct. 22, 2001 still pending which is a Continuation-In-Part of U.S. patent application Ser. No. 09/784,981 entitled "Electrical Fixture Mounting Box and Mounting Assembly", filed Feb. 16, 2001 now U.S. Pat. No. 6,355,883.

FIELD OF THE INVENTION

The present invention relates to devices and methods for mounting ceiling fans and other large and heavy electrical fixtures to sloped ceilings. More particularly, the present invention describes a mounting block that includes an integral electrical junction box for completing wiring connections, fasteners held in temporary storage locations for the purpose of securing the mounting block to a structural support, and fasteners held in temporary storage locations for the purpose of securing an electrical fixture to the mounting block.

BACKGROUND OF THE INVENTION

Recently, in the hardware and construction industry, it has become desirable to include fasteners with each separate device used. Electrical mounting devices such as outlet boxes for example, are supplied by the manufacturer with fasteners attached to each separate device. This allows a hardware outlet to display and market a total package to the consumer, freeing the consumer from separately finding and purchasing the fasteners required to complete the job. It also eliminates the time and effort required for the consumer to locate the correct bin and obtain the correct fastener. By supplying the correct fasteners with each device, both the homeowner and professional installers are freed of the task of locating fasteners at the time of installation. Prepackaged fasteners therefore are very convenient and desirable in modern construction or remodeling projects.

One application that would benefit from prepackaged fasteners includes those homes and commercial buildings that include sloped ceilings. It is a common desire to hang electrical fixtures such as lights and fans from the sloped ceiling. Although many mounting devices have been proposed for this task, they typically do not include prepackaged fasteners as part of the mounting device. This forces the installer to obtain the fasteners separately and have them ready at the time of installation. In addition, if the fasteners are not conveniently located with the mounting device, it becomes quite tedious for an installer to hold the mounting device overhead while inserting a fastener, thread the fastener into a support structure, and tighten the fastener therein enough to secure the device to the structure.

Several manufacturers have sought to include fasteners with the mounting device by packaging the device in a container, such as a box, and including the fasteners in a separate container within the box, such as a plastic bag. This solves the problem of obtaining the fasteners separately, but is undesirable as the packaging adds to the cost of the device and the fasteners are not held in a location convenient to the job. The installer must typically remember to remove the bag of fasteners and carry it with the device to the installation site.

U.S. Pat. No. 5,762,223 to Kerr, Jr. (hereinafter the '223 patent) provides a device for mounting ceiling-suspended electrical fixtures to a sloped ceiling that includes prepackaged fasteners. This disclosure proposes either a pair of transversely extending narrow grooves or bosses that cooperate with semi-circular dependent posts to store mounting screws during shipment and until ready for use. As the screws of the '223 patent have very limited surface contact with the surrounding structure, the frictional fit is limited and therefore the mounting screws can easily be jarred loose during shipment. It therefore becomes necessary to wrap the mounting assembly or provide an outer package to hold the mounting screws inside the assembly during storage and shipment.

U.S. Pat. No. 6,355,883 to Gretz, incorporated herein by reference in its entirety, therefore proposed a mounting assembly that included extended recesses and apertures the purpose and utility of which was to provide a location for the placement of mounting bolts or screws during shipment and prior to installation. As stated in this disclosure, the inclusion of mounting bolts or screws, frictionally engaged in apertures assures the immediate availability of such fasteners at the appropriate time to the installation process.

U.S. patent application Ser. No. 10/017,571, filed Oct. 22, 2001 and incorporated herein by reference in its entirety, proposed a mounting assembly for a level ceiling including a junction box and at least one holster included with the box. The holster comprised an integral tubular projection from the box with the tubular projection open to and communicating with the interior volume at a first end joining the box and either open or closed at a second end away from the box. This disclosure therefore proposed an electrical device mounting assembly that provided prepackaged fasteners. The prepackaged fasteners are provided in temporary storage receptacles during storage and shipment of the box. At the assembly site, the fasteners are typically moved to the appropriate location for anchoring the box.

U.S. patent application Ser. No. 10/012,584, filed Nov. 7, 2001, and U.S. patent application Ser. No. 10/287,088, filed Nov. 4, 2002, both incorporated herein by reference in their entirety, provided an L-shaped mounting assembly for flush mounting on a level rafter. The mounting assemblies included integral holsters as temporary storage locations for fasteners during storage and shipment. The holsters provide a temporary storage location for the fasteners, protect their ends while storing them therein, and hold the fasteners securely until they are purposely removed by the user.

Although the above referenced inventions and disclosures provide various mounting assemblies, they do not provide an adequate prepackaged mounting assembly for a sloped ceiling including an arrangement for temporary storage of fasteners. What is therefore needed to overcome deficiencies in the prior art is a prepackaged mounting assembly for mounting electrical fixtures on sloped ceilings.

The mounting assembly of the present invention will therefore include all required mounting fasteners with the assembly.

The mounting assembly will furthermore provide a means of holding the fasteners very securely, so that there will be no loss or displacement of fasteners during storage or shipment.

The mounting assembly will hold the fasteners in a manner that the ends of the fasteners are protected during storage and shipment.

The present invention therefore provides a mounting assembly that does not require separate packaging enclosing it or enclosing fasteners provided separately with the assembly.

The present invention will furthermore provide a mounting block including an integral junction box for wiring connections.

The mounting assembly of the present invention also provides an assembly that allows easy mounting of electrical fixtures to sloped ceilings.

These, and other advantages will be apparent to a person skilled in the art by reading the attached description along with reference to the attached drawings.

SUMMARY OF THE INVENTION

According to the present invention, there is provided a mounting assembly for securing an electrical fixture, such as a ceiling fan, light fixture, or similar device to a sloped ceiling. The mounting assembly includes two embodiments, one for use with a cathedral ceiling and one for use with a vaulted ceiling. The mounting assembly includes a box having an open top, a closed bottom, a side wall, and an electrical wiring enclosure integral with the closed bottom. Provided with the box are integral holsters for temporary storage of threaded fasteners. The electrical enclosure includes a top wall having a seat thereon for flush fitting against an appropriate brace and an initial fastening screw partially secured in a boss below the seat. The box is secured to a brace using the initial fastening screw, the brace is secured to an overhead rafter on a sloped ceiling, and an electrical fixture installed to the mounting assembly by removing the threaded fasteners from their respective holsters and securing them through the bracket of the electrical fixture and into the brace.

TABLE OF NOMENCLATURE

Figure 1:
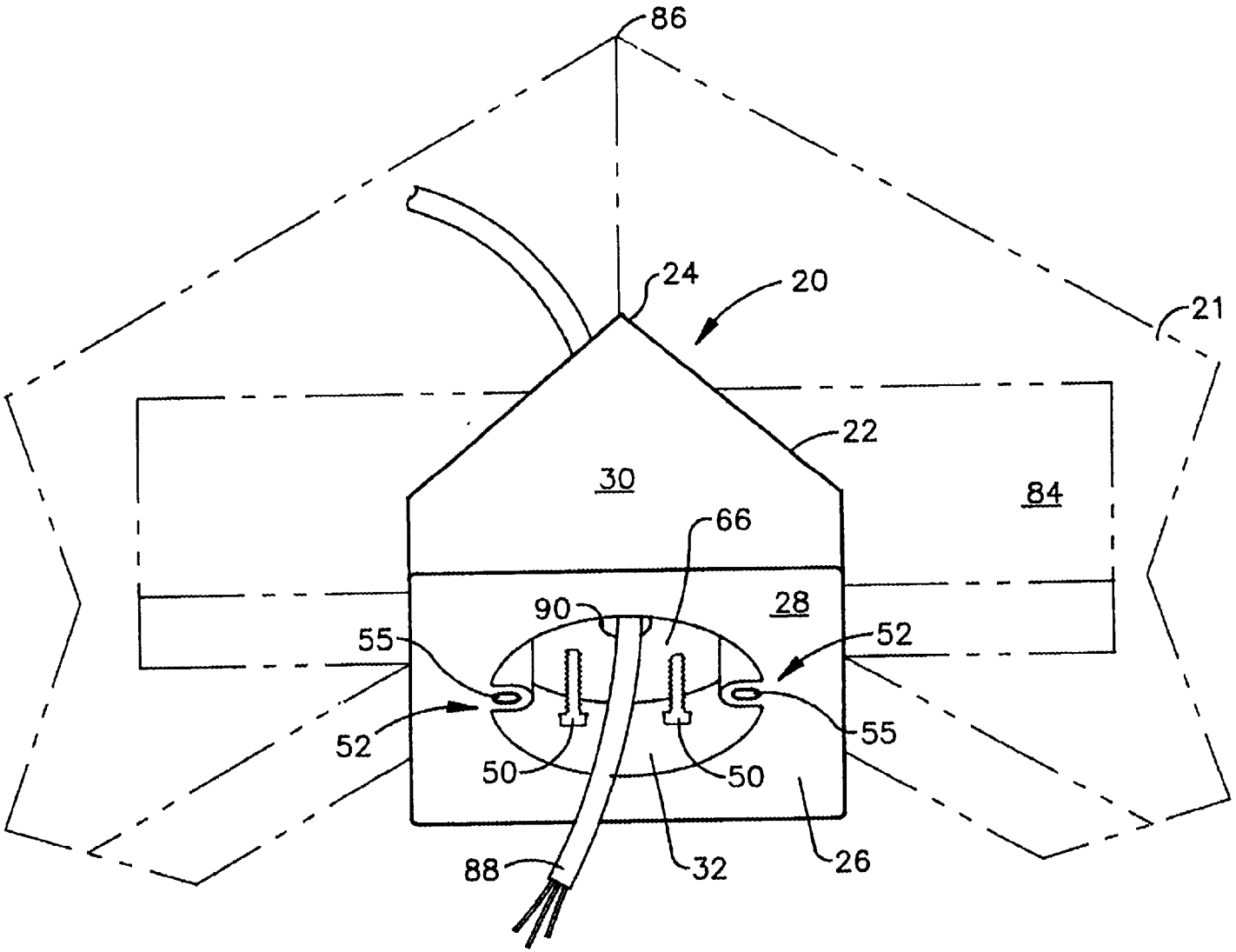
FIG. 1 is a perspective view of a first embodiment of a prepackaged mounting assembly for mounting an electrical fixture to a cathedral ceiling, showing the mounting assembly secured to a rafter and electrical cable and wiring fed into the integral electrical box.

The following is a listing of part numbers used in the drawings along with a brief description:

| Part Number | Description |
|---|---|
| 20 | prepackaged mounting assembly |
| 21 | rafter |
| 22 | box |
| 24 | open top |
| 26 | closed bottom |
| 28 | bottom surface |
| 30 | side wall |
| 30A | short wall |
| 30B | extended wall |
| 31A | short wall |
| 31B | high wall |
| 31C | extended wall |
| 32 | electrical enclosure |
| 34 | top wall of electrical enclosure |
| 36 | top surface of top wall |
| 38 | bottom surface of top wall |
| 40 | first aperture |
| 42 | bosses |
| 44 | initial fastener |
| 46 | holster |
| 48 | tube-like receptacles |
| 50 | threaded fastener |
| 52 | fastening arrangement |
| 54 | side wall of electrical enclosure |
| 55 | aperture |
| 56 | tubular walls |
| 58 | frangible wall section |
| 60 | cable fitting |
| 64 | integral tang |
| 66 | interior volume of electrical enclosure |
| 68 | wall section |
| 70 | top inner bore |
| 72 | bottom inner bore |
| 74 | smooth interior side wall |
| 75 | central bore of holster |
| 76 | open end of holster |
| 77 | closed end of holster |
| 78 | point of threaded fastener |
| 80 | prepackaged mounting assembly |
| 81 | central peak |
| 82 | seat |
| 84 | brace |
| 86 | apex |
| 88 | electrical cable |
| 90 | knockout |
| 92 | peak |
| 94 | rib |

DETAILED DESCRIPTION

A perspective view of a first embodiment of a prepackaged mounting assembly 20 is shown in FIG. 1. The mounting assembly of FIG. 1 is used to secure an electrical fixture (not shown) to rafters 21 at the apex of a cathedral ceiling. The mounting assembly 20 includes a box 22 having a top 24, a closed bottom 26 with a bottom surface 28, and a side wall 30. An electrical enclosure 32 is integral with the closed bottom 26.

Figure 3:
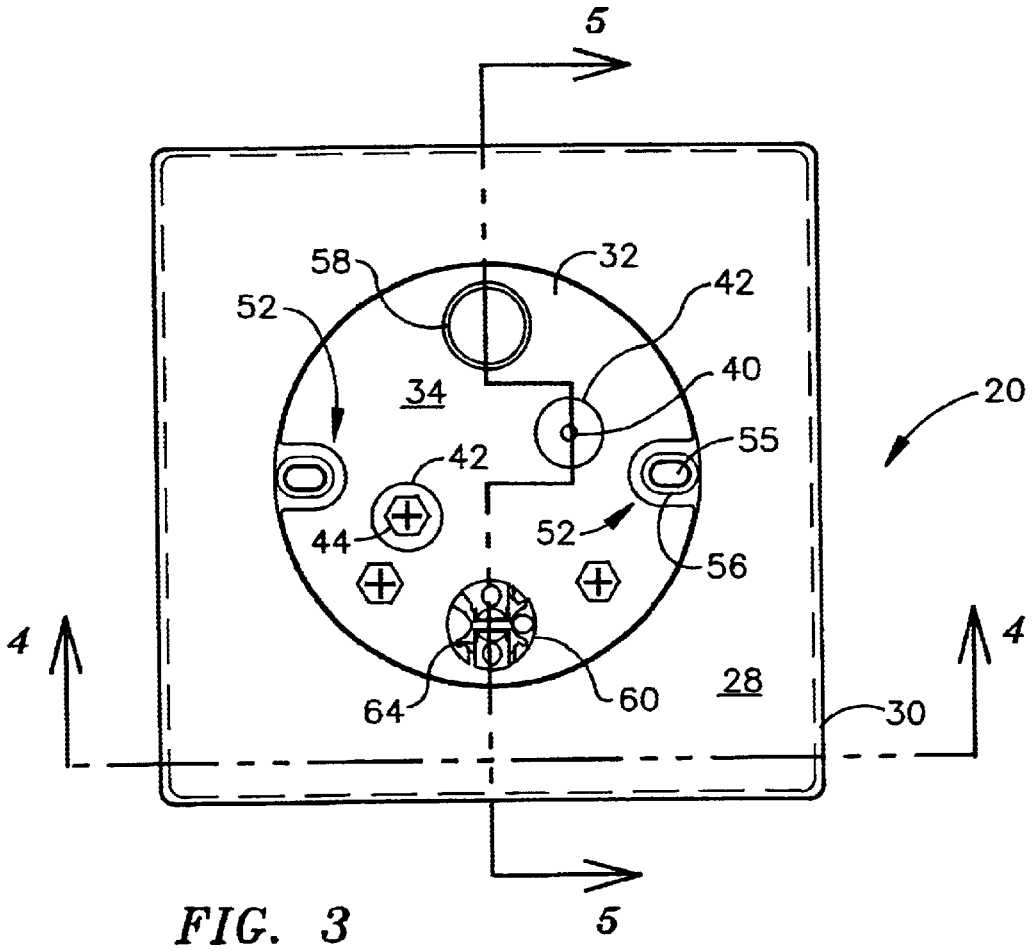
FIG. 3 is a bottom view of the prepackaged mounting assembly of FIG. 1.
Figure 4:
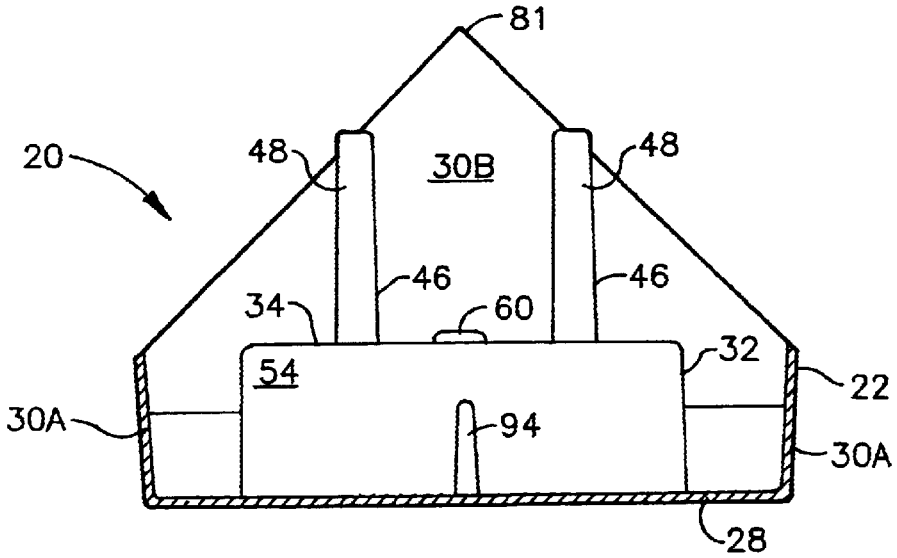
FIG. 4 is a sectional view of the prepackaged mounting assembly taken along lines 4—4 of FIG. 3.
Figure 5:
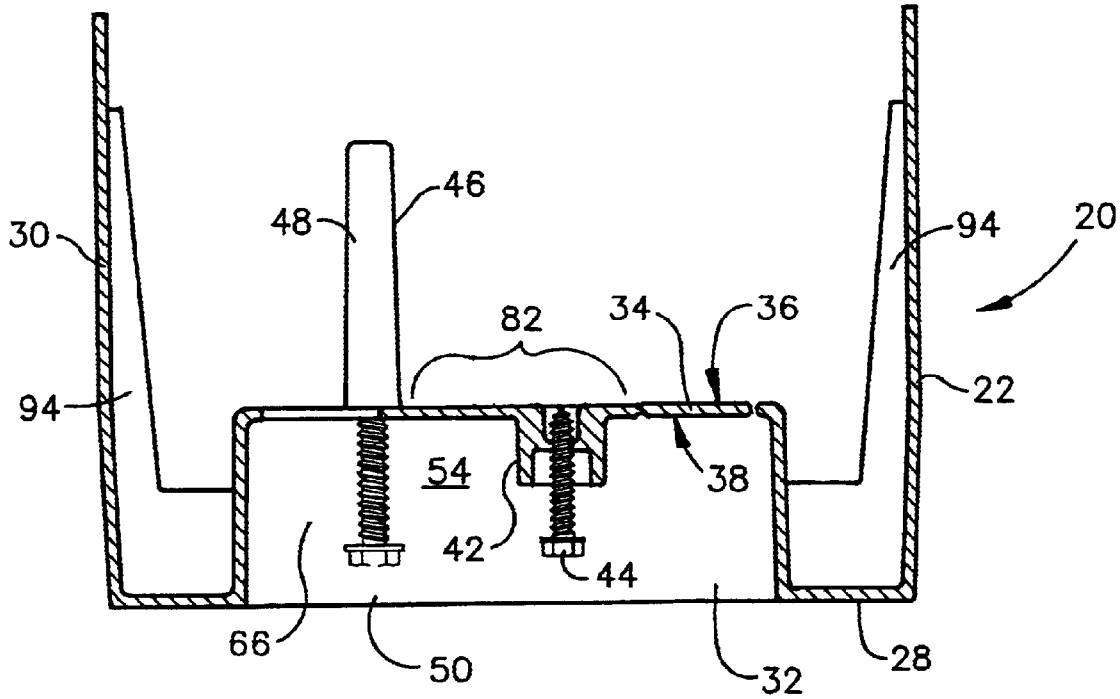
FIG. 5 is a sectional view of the prepackaged mounting assembly taken along lines 5—5 of FIG. 3.

Referring to FIGS. 3–5, the integral electrical enclosure 32 includes a top wall 34 having a top 36 and a bottom surface 38. The top wall 34 of the electrical enclosure 32 includes first apertures 40. Surrounding each first aperture 40 and integral with the bottom surface 38 are bosses 42 with initial fasteners 44 held securely therein. Integral with and extending from the top surface 36 of the electrical enclosure 32 are holsters 46, which include tube-like receptacles 48 for receipt of threaded fasteners 50. The top wall 34 also includes a fastening arrangement 52 near the side wall 54 of the electrical enclosure 32. The fastening arrangement 52 includes apertures 55 surrounded by tubular walls 56. Any fastener inserted within the fastening arrangement will be insulated from the electrical enclosure 32 by the tubular walls 56. Frangible wall sections 58 are also provided in the top wall 34. The frangible wall sections 58 may be removed and electrical cable fittings 60 secured therein. The cable fittings 60 typically include flexible integral tangs 64 facing inward and downward of the top wall 34 such that the tangs 64 project into the electrical enclosure 32. The bottom surface 28 of the box 22 is a planar surface. As shown in the sectional view of FIG. 5, the top wall 34 and side walls 54 of the integral electrical enclosure 32 define an interior volume 66.

Figure 6:
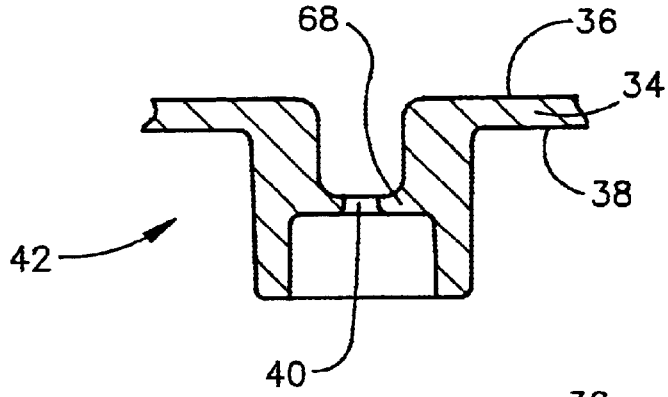
FIG. 6 is a cross sectional view of a boss integral with the top wall of the electrical junction box.
Figure 7:
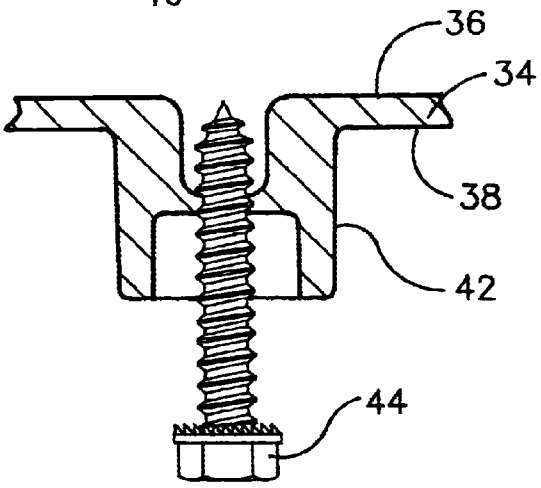
FIG. 7 is a cross sectional view of the boss of FIG. 6 and showing a fastener secured therein.

Referring to FIGS. 6 and 7, the boss 42 is integral with the top wall 34 and extends from the bottom surface 38 of the top wall. The first aperture 40 is formed within the boss and includes a wall section 68 that is self-threaded by the initial fastener 44 as it is rotated therein. The box 22 is typically formed of a rigid plastic in an injection molding operation and the rigid wall sections 68 therefore are capable of being self threaded by initial fastener 44.

Figure 8:
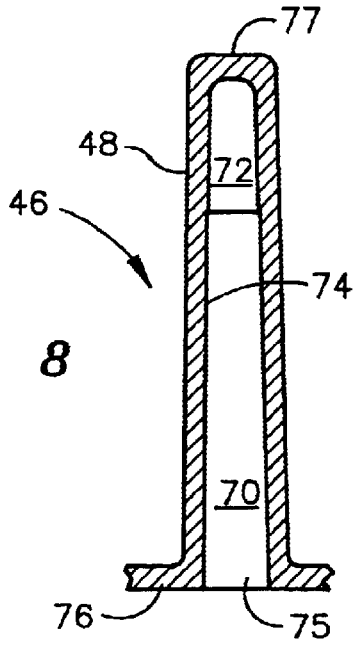
FIG. 8 is a cross sectional view of a holster according to the present invention.
Figure 9:
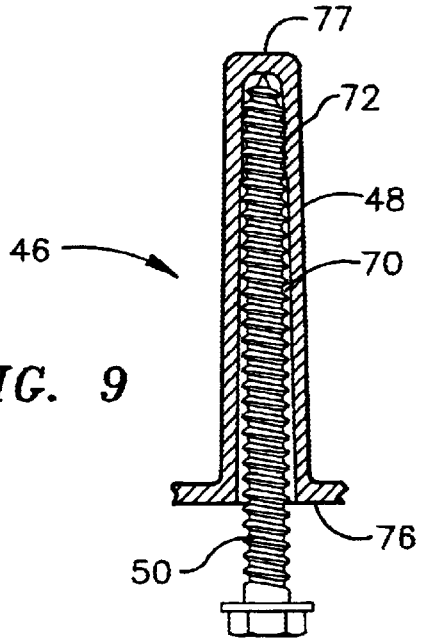
FIG. 9 is a cross sectional view of the holster of FIG. 8 and showing a threaded fastener secured therein.

With reference to the sectional views of FIGS. 8 and 9, the holsters 46 include tube-like receptacles 48 having a top inner bore 70 and a bottom inner bore 72 with the top inner bore 70 of a larger diameter than the bottom inner bore 72. Both the top 70 and bottom 72 inner bores have smooth interior side walls 74. As shown in FIG. 9, the holster 46 provides a temporary storage location for a threaded fastener 50.

Referring to FIGS. 8 and 9, a side sectional view is shown of a screw-retaining holster 46 that will be used to hold a fixture mounting screw for shipment with the prepackaged mounting assembly to a job site. As used within this disclosure, a holster 46 is defined as an enclosure integral with a fixture mounting box for frictionally holding a threaded fastener 50 so that it does not become separated from the box during storage and shipment, including a central bore 75 open on at least one end 76 for receipt of the threaded fastener 50 and preferably closed on its second end 77 for protecting the end of the threaded fastener. The central bore 75 of the holster 46 includes a top inner bore 70 and a bottom inner bore 72 with the top inner bore 70 of a larger diameter than the bottom inner bore 72, as shown in FIG. 8. Both the top 70 and bottom 72 inner bores include smooth interior side walls 74.

Referring to FIG. 9, with a #12×3-inch sheet metal screw used as the threaded fastener 50, the top inner bore 70 of the holster 46 typically measures 0.250 inch and the bottom inner bore 72 typically measures 0.190 inch. Preferably, the interior wall 74 of the top 70 and bottom 72 inner bores of each holster 46 is smooth. A smooth surface on the top inner bore 70 enables the threaded fastener 50 to easily slip into the holster 46 presenting no obstruction to the fastener as it moves therein. A smooth surface on the bottom inner bore 72 enables the threaded fastener 50 to rapidly and easily self-tap and make its own thread. The combination of the smooth surface and dimensions of the top inner bore 70 allows the threaded fastener 50, with a nominal major thread diameter of 0.2115 inch, to enter the top inner bore easily. The threaded fastener 50 can then be screwed partially into the bottom inner bore 72, where it makes its own threads in the smooth surface 74, and can be advanced until it is held securely for shipment. The threaded fasteners 50 can then easily be removed by an installer at the job site and repositioned to the apertures 55 in the fastening arrangement 52, shown in FIGS. 3 and 10, to secure a ceiling fan or other fixture to a sloped ceiling.

As shown in FIG. 9, once inserted in the holster 46, the point 78 of the threaded fastener 50 is enclosed within and protected by the holster 46. The holsters 46 therefore protect the ends or points 78 of the threaded fasteners 50 during storage and shipment of the box. The holsters also therefore provide protection to the installer, as the sharp points of the fasteners are covered until the installer is ready to transfer the fasteners to their eventual usage positions in the fastening arrangement.

Figure 2:
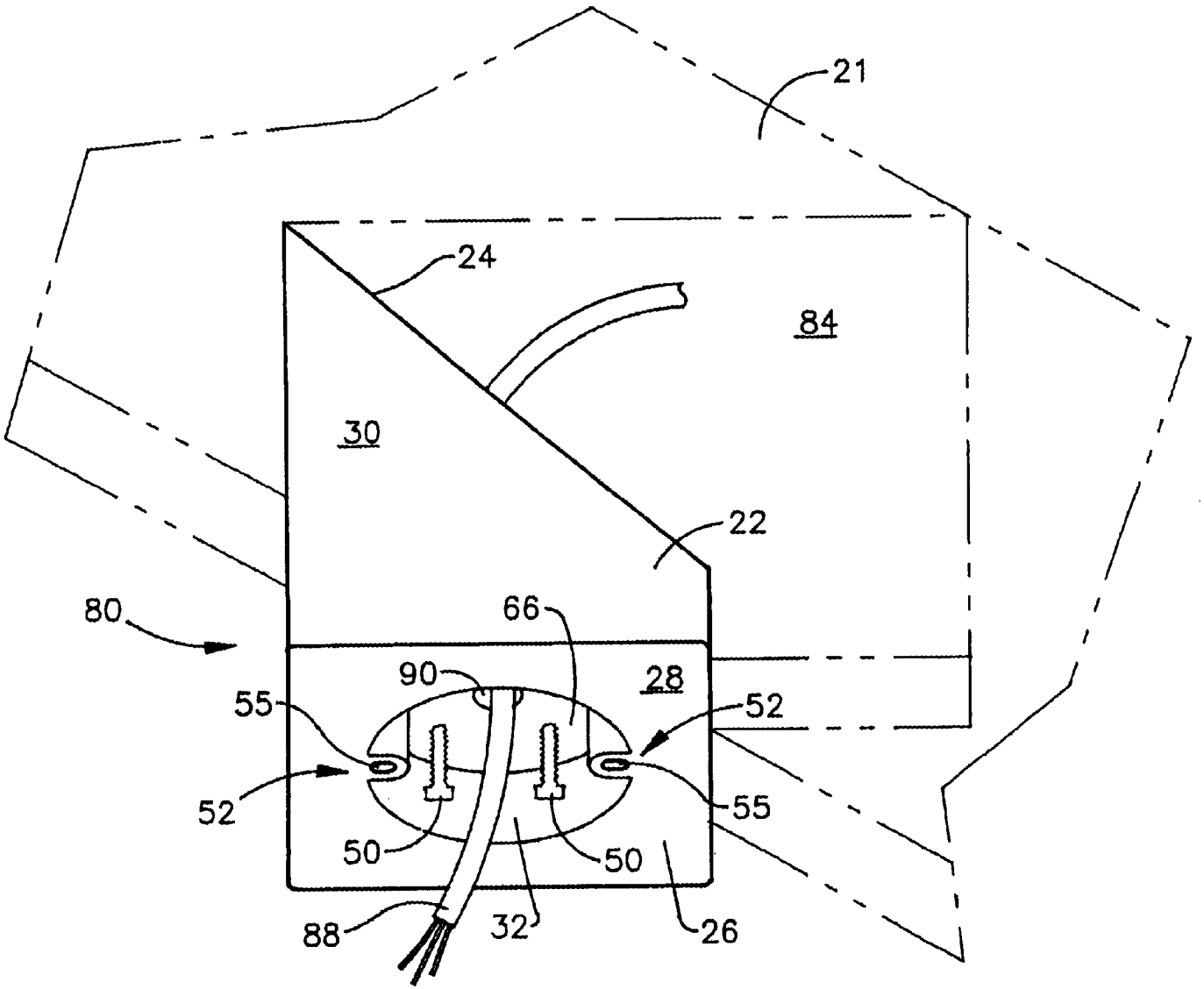
FIG. 2 is a perspective view of a first embodiment of a prepackaged mounting assembly for mounting an electrical fixture to a vaulted ceiling, showing the mounting assembly secured to a rafter and electrical cable and wiring fed into the integral electrical box.

FIG. 2 depicts a second embodiment of the prepackaged mounting assembly 80 that is used for securing an electrical fixture to a rafter 21 on the sloped portion of a vaulted ceiling. The mounting assembly 80 includes a box 22 having a top 24, a closed bottom 26 with a bottom surface 28, and a side wall 30. An electrical enclosure 32 is integral with the closed bottom 26.

Figure 10:
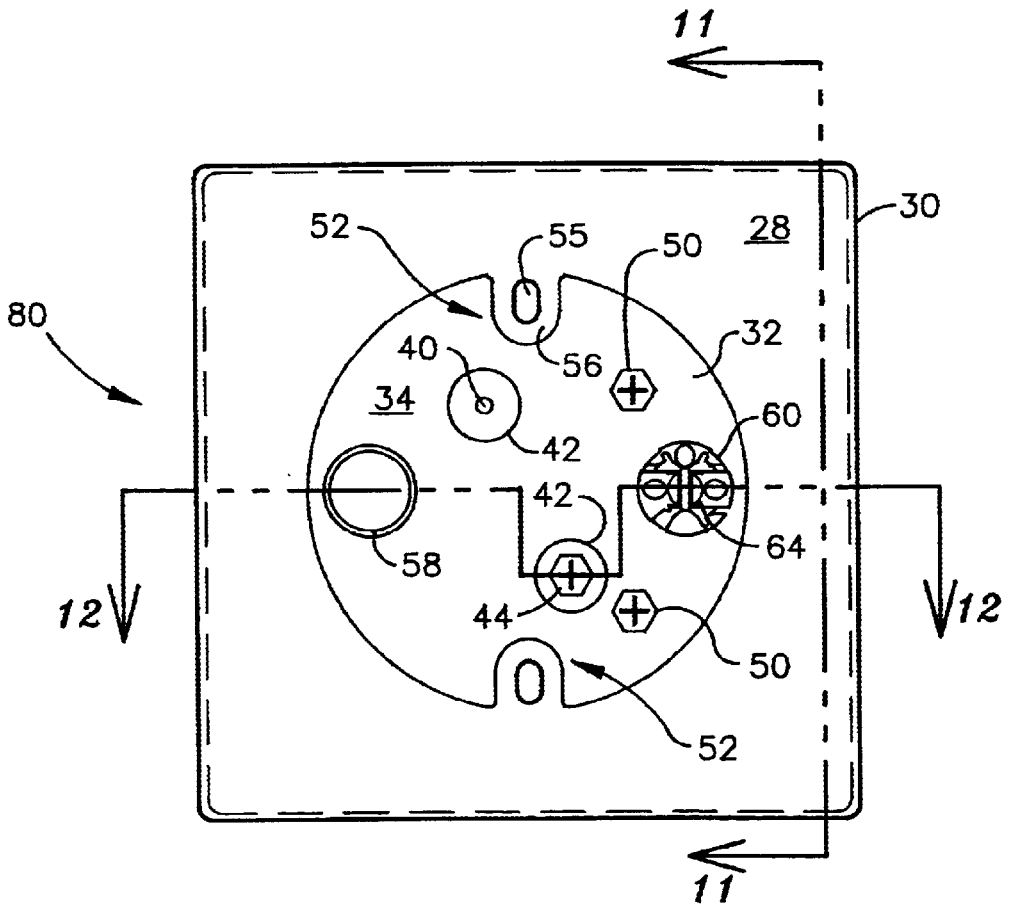
FIG. 10 is a bottom view of the prepackaged mounting assembly of FIG. 2.
Figure 11:
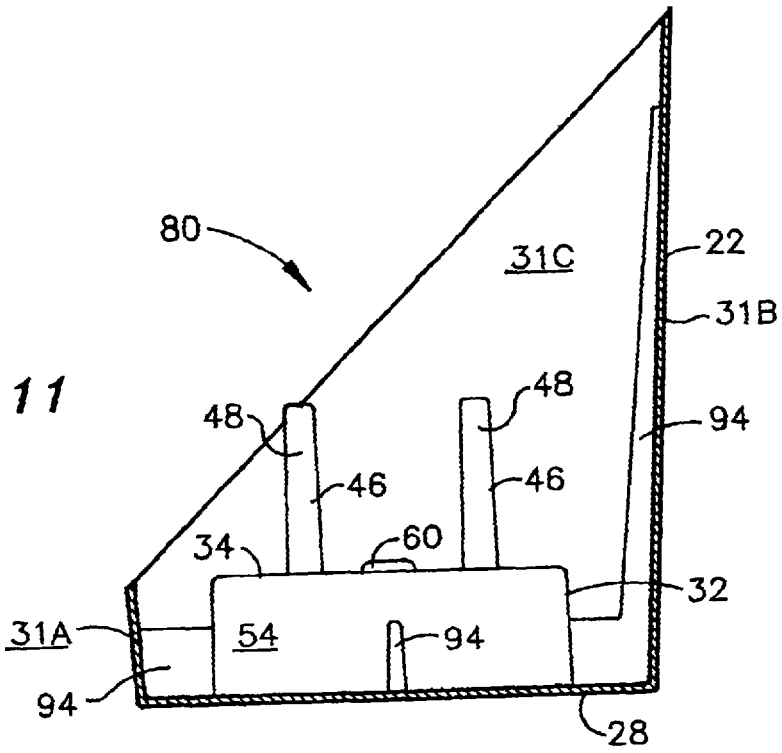
FIG. 11 is a sectional view of the prepackaged mounting assembly taken along lines 11—11 of FIG. 10.
Figure 12:
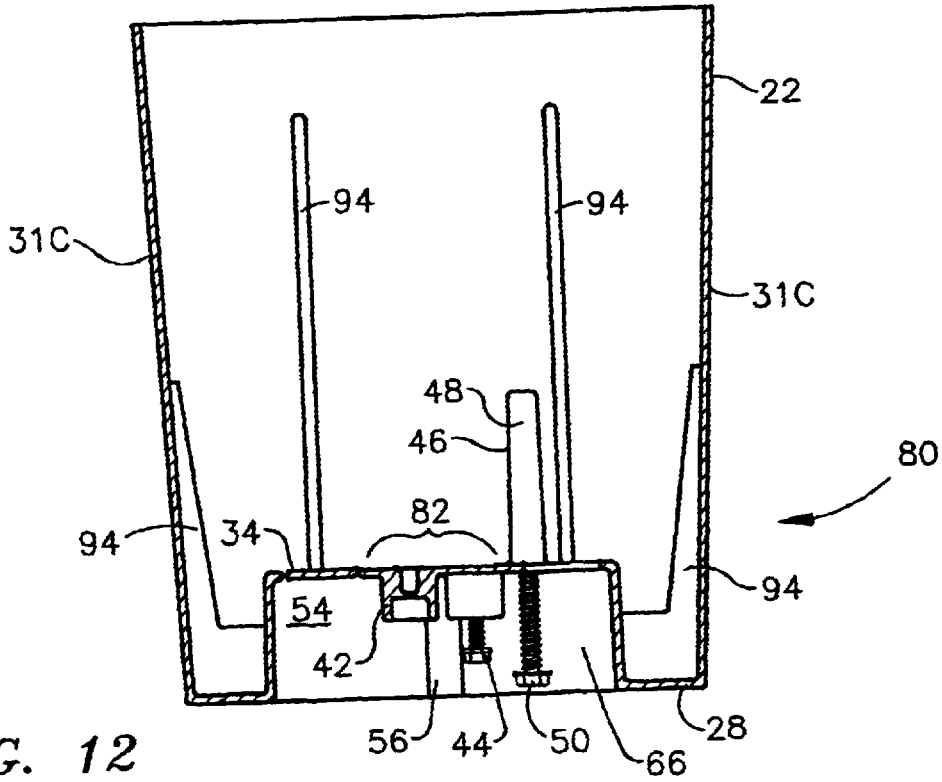
FIG. 12 is a sectional view of the prepackaged mounting assembly taken along lines 12—12 of FIG. 10.

Referring to FIGS. 10–12, the integral electrical enclosure 32 of the second embodiment of the prepackaged mounting assembly 80 includes elements analogous to those in the first embodiment, including a top wall 34 having a top 36 and a bottom surface 38. The top wall 34 of the electrical enclosure 32 includes first apertures 40 and bosses surrounding each first aperture 40 with initial fasteners secured therein. Holsters 46 include tube-line receptacles 48 that are integral with and extend from the top surface 36 of the electrical enclosure 32. The tube-like receptacles 48 receive threaded fasteners 50 therein. As in the first embodiment, the prepackaged mounting assembly 80 includes apertures 55 and frangible wall sections 58 which may include an electrical cable fittings 60 secured therein. The bottom surface 28 of the box 22 is a planar surface. As shown in the sectional view of FIG. 12, the top wall 34 and side walls 54 of the integral electrical enclosure 32 define an interior volume 66.

The prepackaged mounting assembly of the present invention has the advantage of providing an installer all of the fasteners required to secure an electrical fixture to either the apex or non-apex area of a sloped ceiling. The first embodiment of the prepackaged mounting assembly 20 shown in FIG. 4, for example, includes two opposing short walls 30A and two opposing extended walls 30B, one of which is shown, that have a central peak 81. An inverted V-shaped top peripheral edge is therefore formed by the extended walls 30B. As shown in FIG. 5, one or more initial fasteners 44 are securely held within bosses 42 and one or more threaded fasteners 50 are securely held within holsters 46. The central portion of the top surface 36 of the integral electrical enclosure 32 defines a seat 82. A brace 84, typically consisting of a short piece of wood such as a 2×4, is measured to span between two rafters 21 at the apex 86 of a ceiling, such as shown in FIG. 1. The box 22 of the prepackaged mounting assembly 20 is typically inverted, placed against brace 84 such that the planar bottom surface 28 of the box 22 is level, and secured thereto by tightening the initial mounting screws 44 completely into the integral bosses 42 and into the brace 84. The box 22 and brace 84 are then inverted as shown in FIG. 1, and the brace 84 secured to the rafters 21 in the desired position. An electrical cable 88 is then fed through a knockout 90 created by removal of a frangible area in the top wall 34 of the electrical enclosure 32 and into the interior volume 66 of the electrical enclosure 32. The bracket (not shown) of an electrical fixture is then raised into close proximity of the box 22. The spacing between the axial centers of the apertures 55 of the fastening arrangement 52 matches the apertures on a typical bracket of an electrical fixture. Furthermore, the fastening arrangements 52 are typically centered below the seat area on the top of the integral junction box. With the box 22 secured to the brace 84 and the brace secured to the rafters 21 as shown in FIG. 1, pilot holes may be drilled in alignment with the apertures 55 of the fastening arrangement 52. The installer then simply unscrews the threaded fasteners 50 from their respective holsters, centers the apertures of the electrical fixture bracket on the apertures 55 of the fastening arrangement 52, passes the threaded fasteners through the apertures 55 of the fastening arrangement 52, and partially screws the fasteners 50 into the brace 84. Wiring connections can then be completed and the wiring placed into the electrical enclosure 32. The threaded fasteners 50 are then screwed firmly into the brace 84 thereby securing the fixture bracket and the fixture to the box 22.

As should be understood by the above description, all of the hardware required to mount the box 22 of the prepackaged mounting assembly 20 to the apex of a cathedral ceiling is temporarily secured to the box 22. The initial fasteners 44 are secured firmly into their bosses 42 and the threaded fasteners 50 are secured firmly into the holsters 46. The fasteners 44, 50 are tightly secured therein to prevent their loosening or falling out during storage and shipment of the assembly 20. However, once ready to be used, the initial fasteners 44 are easily screwed and driven further into their bosses 42 and thence into the brace 84. The threaded fasteners 50 are easily removed from their temporary storage in the holsters 46 by a manual or mechanized screwdriver, and thence moved to the fastening arrangements 52 and driven into the brace 84. It should be understood that this type of arrangement, using integral tube-like receptacles 48 for temporary storage of fasteners, has inherent advantages over prior art storage devices, such as storing fasteners in plastic bags or a frictional fit between pins or clips.

Referring to FIG. 11, the second embodiment of the prepackaged mounting assembly 80, includes one short wall 31A, a high wall 31B opposite the short wall, and two opposing extended walls 31C, one of which is shown, that angle upwards at a constant rate from the short wall 31A to a peak 92 at the high wall 31B. The top of the extended walls 31C therefore form a top peripheral edge that conforms to the slope of a vaulted ceiling. As shown in FIG. 12, one or more initial fasteners 44 are securely held within bosses 42 and one or more threaded fasteners 50 are securely held within holsters 46. The central portion of the top surface 36 of the integral electrical enclosure 32 defines a seat 82. A brace 84, typically consisting of a short piece of wood such as a 2×6, is cut to fit against a rafter 21, such as shown in FIG. 2. The box 22 of the prepackaged mounting assembly 80 is typically inverted, placed against brace 84 such that the planar bottom surface 28 of the box 22 is level, and secured thereto by tightening the initial mounting screws 44 completely into the integral bosses 42 and into the brace 84. The box 22 and brace 84 are then inverted as shown in FIG. 1, and the brace 84 secured to the rafters 21 in the desired position.

The remainder of the installation procedure for the second embodiment of the prepackaged mounting assembly 80 is analogous to that described above for the first embodiment. An electrical cable 88 fed into the interior volume 66 of the electrical enclosure 32. The bracket (not shown) of an electrical fixture is raised into close proximity with the box 22. Pilot holes are drilled in alignment with the apertures 55 of the fastening arrangement 52. The threaded fasteners 50 are then unscrewed from their respective holsters 46, passed through the apertures 55 of the fastening arrangement 52, and partially screwed into the brace 84 to secure the electrical fixture to the box 22. Wiring connections are completed, and the fasteners 50 tightened completely into the brace 84 thereby securing the fixture bracket and fixture to the box 22.

Referring to FIGS. 5 and 12, when mounted within the holsters 46 for shipment and storage, essentially the entire length of each threaded fastener 50 is recessed within and protected by the side walls 54 of the electrical enclosure 32.

The purpose and utility of the holsters 46 is to provide a location for the placement of threaded fasteners 50 during shipment and prior to installation. The threaded fasteners 50 may be screws, bolts, or similar threaded fasteners. As is well recognized by those employed in the electrical trades, mounting bolts or screws for the attachment of ceiling fans or other electrical fixtures are often misplaced or left at a position remote from the installation site, for example on the floor, requiring time and effort to locate the screws or bolts or the acquisition of replacements to complete an installation. The inclusion of mounting bolts or screws, frictionally engaged in holsters 46 ensures the immediate availability of such fasteners at the appropriate time in the installation process. Similarly, it is contemplated that the initial mounting fastener 44 that is used to initially fasten the box 22 of the prepackaged mounting assembly to a brace through screw-retaining boss 42 be similarly included by frictional engagement in boss 42 during shipping and prior to installation, as shown in FIGS. 5 and 12.

By providing a prepackaged mounting assembly, the installer avoids having to search for the proper fasteners for the job. The correct fasteners are available with the mounting box when required. Additionally, the required fasteners are held securely within the mounting box until needed, thereby allowing the distributor to package a number of prepackaged mounting assemblies in a shipping container. It is very common and desirable for distributors to package a large number of electrical devices loosely in a shipping container, as it eliminates outer wrap or packaging for each individual device. This makes it easy for a contractor to purchase a container of prepackaged mounting assemblies and pull them out individually when needed. Since each individual device is loose in the shipping container, the contractor would not be inconvenienced with the task of removing outer wrap or individual packaging from each. Packing a number of the mounting assemblies loosely within a box is also attractive to the hardware superstores that prefer to place the opened containers on store shelves for easy access by store customers. Home owners benefit by having easy access to the prepackaged mounting assemblies and by not having to search for, or separately purchase, the proper fasteners.

As previously mentioned, the preferred threaded fasteners 50 are typically #12×3" sheet metal screws, making the fasteners 50 the main anchoring means for supporting the static and dynamic loads created by a typical 70 to 100 pound ceiling fan or similar fixture. The initial mounting fastener 44 also assists in supporting the load and is preferably a #10×1' sheet metal screw.

The box 22 of the prepackaged mounting assemblies 20, 80 of the present invention is typically injection molded in one piece from a suitable plastic. The preferred material of construction may be polyvinyl chloride, polycarbonate, ABS, polyethylene, nylon, or polypropylene.

Referring to FIGS. 5 and 11, integral ribs 94 may be provided with the box to stiffen the box 22 and make it sturdier. These ribs 94 can extend along the high walls such as wall 31B along the right side of the box 22 in FIG. 11, or provide stiffness to a short wall such as wall 31A on the left side of the box 22 in FIG. 11.

As the invention has been described, it will be apparent to those skilled in the art that the same may be varied in many ways without departing from the spirit and scope of the invention. Any and all such modifications are intended to included within the scope of the appended claims.

What is claimed is:

1. A prepackaged mounting assembly for attaching an electrical fixture to a surface comprising:

A. a box including:
(1) a top;
(2) a bottom;
(3) a side wall;

B. an electrical enclosure integral with said bottom;

C. a threaded fastener;

D. a holster integral with said mounting assembly for temporary storage of said threaded fastener, said holster including an extended tube-like receptacle for receipt of said threaded fastener that permits protection during storing and shipment and ready extraction of said threaded fastener for use in mounting said prepackaged mounting assembly;

E. said tube-like receptacle including
(1) a mouth;
(2) a top inner bore at said mouth;
(3) a bottom inner bore further within;
(4) said top inner bore of a larger diameter and said bottom inner bore of a smaller diameter than the major thread diameter of said threaded fastener; and
(5) said top and said bottom inner bores having smooth interior side walls.

2. The prepackaged mounting assembly of claim 1 wherein said box is constructed of plastic.

3. The prepackaged mounting assembly of claim 2 wherein said box is constructed of polyvinyl chloride, polycarbonate, ABS, polyethylene, nylon, or polypropylene.

4. A prepackaged mounting assembly for attaching an electrical fixture to a surface comprising:

A. a box including:
(1) a top;
(2) a bottom;
(3) a side wall;

B. an electrical enclosure integral with said bottom;

C. a threaded fastener;

D. a holster integral with said mounting assembly for temporary storage of said threaded fastener, said holster including an extended tube-like receptacle for receipt of said threaded fastener that permits protection during storing and shipment and ready extraction of said threaded fastener for use in mounting said prepackaged mounting assembly;

E. said electrical enclosure including
(1) a top wall having a top and a bottom surface;
(2) a side wall;
(3) a first aperture in said top wall;
(4) a boss on said bottom surface surrounding said first aperture; and
(5) an initial mounting fastener having a point and secured within said boss, said initial mounting fastener secured such that said point is held securely within said boss, said point furthermore does not extend beyond said top surface.

5. The prepackaged mounting assembly of claim 4 wherein said top wall of said electrical enclosure includes one or more frangible wall sections which can be removed to provide a an opening there through for passing wiring into said electrical enclosure.

6. The prepackaged mounting assembly of claim 5 wherein said frangible wall section is removed and said opening includes an electrical cable fitting secured therein, said cable fitting including an inner periphery, said cable fitting fabricated of flexible plastic and including a plurality of integral tangs facing inward from said inner periphery, said integral tangs furthermore projecting from said inner periphery inwards of said top wall into said electrical enclosure, said integral tangs flexible thereby allowing passage of a cable there through but afterwards preventing withdrawal of said cable from said enclosure.

7. The prepackaged mounting assembly of claim 4 wherein said top surface of said top wall of said electrical enclosure includes a seat thereon, said seat centered on said top wall, said seat capable of accepting flush fitting of a brace thereon.

8. The prepackaged mounting assembly of claim 7 wherein said seat includes said first aperture in said top wall for acceptance of said initial mounting fastener.

9. The prepackaged mounting assembly of claim 8 further including a fastening arrangement for cooperating with said threaded fastener for securing an electrical fixture to said mounting assembly, said fastening arrangement including two second apertures in said seat of said top wall, said second apertures spaced apart to match the spacing in a typical bracket of a wall-mounted electrical fixture, thereby permitting said threaded fastener to be moved from said holster, passed through said bracket, and tightened through said second apertures and into said brace.

10. The prepackaged mounting assembly of claim 9 further including tubular walls projecting from an inner surface of said top wall to said bottom surface of said box, said tubular walls electrically insulating said threaded fastener from said interior volume of said electrical enclosure.

11. The prepackaged mounting assembly of claim 7 wherein frangible wall sections are located in said top wall outwards of said seat, thereby allowing writing to be passed around said brace and into the interior volume of said electrical enclosure.

12. The prepackaged mounting assembly of claim 7 wherein said tube-like receptacle is located in said top wall outwards of said seat, thereby allowing said tube-like receptacle to extend from said top wall of said enclosure adjacent to said brace.

13. A prepackaged mounting assembly for attaching an electrical fixture to a surface comprising:

A. a box including:
(1) a top;
(2) a bottom;
(3) a side wall;

B. an electrical enclosure integral with said bottom;

C. a threaded fastener;

D. a holster integral with said mounting assembly for temporary storage of said threaded fastener, said holster including an extended tube-like receptacle for receipt of said threaded fastener that permits protection during storing and shipment and ready extraction of said threaded fastener for use in mounting said prepackaged mounting assembly;

E. said side wall including (1) two opposing short walls having a top edge;

(2) two opposing extended walls having a peak midway between said short walls; and (3) said extended walls extending from said top edge of said short walls to said peak of said extended walls so as to form an inverted V-shaped top peripheral edge.

14. A prepackaged mounting assembly for attaching an electrical fixture to a surface comprising:

A. a box including:

(1) a top;

(2) a bottom;

(3) a side wall;

B. an electrical enclosure integral with said bottom;

C. a threaded fastener;

D. a holster integral with said mounting assembly for temporary storage of said threaded fastener, said holster including an extended tube-like receptacle for receipt of said threaded fastener that permits protection during storing and shipment and ready extraction of said threaded fastener for use in mounting said prepackaged mounting assembly;

E. said side wall including (1) a short wall having a top edge;

(2) a high wall opposite said short wall including a top edge;

(3) two opposing extended walls having a peak at said top edge of said high wall; and (4) said extended walls extending angularly from said top edge of said short wall to said top edge of said high wall so as to form a top peripheral edge non-planar to said bottom.

* * * * *